US006186237B1

(12) United States Patent
Voss, Jr. et al.

(10) Patent No.: US 6,186,237 B1
(45) Date of Patent: Feb. 13, 2001

(54) ANNULUS CHECK VALVE WITH TUBING PLUG BACK-UP

(75) Inventors: Robert K. Voss, Jr., Houston; Charles D. Bridges, Cypress, both of TX (US)

(73) Assignee: ABB Vetco Gray Inc., Houston, TX (US)

( * ) Notice: Under 35 U.S.C. 154(b), the term of this patent shall be extended for 0 days.

(21) Appl. No.: 09/165,838

(22) Filed: Oct. 2, 1998

Related U.S. Application Data

(60) Provisional application No. 60/060,550, filed on Oct. 2, 1997.

(51) Int. Cl.[7] ..... E12B 34/04
(52) U.S. Cl. ..... 166/337; 166/348
(58) Field of Search ..... 166/337, 345, 166/348, 386, 208, 250.08

(56) References Cited

U.S. PATENT DOCUMENTS

| | | | | |
|---|---|---|---|---|
| 3,800,869 | * | 4/1974 | Herd et al. | 166/337 |
| 3,847,215 | * | 11/1974 | Herd | 166/337 |
| 4,223,738 | | 9/1980 | Boutet et al. . | |
| 4,474,236 | * | 10/1984 | Kellet | 166/348 |
| 4,958,686 | | 9/1990 | Putch . | |
| 5,143,158 | | 9/1992 | Watkins et al. . | |
| 5,769,162 | | 6/1998 | Bartlett et al. . | |

FOREIGN PATENT DOCUMENTS

| | | |
|---|---|---|
| 2291085A | 1/1996 | (GB) . |
| 2311544A | 10/1997 | (GB) . |
| 2311545 | 10/1997 | (GB) . |
| WO 97/11253 | 3/1997 | (WO) . |

* cited by examiner

*Primary Examiner*—Eileen D. Lillis
*Assistant Examiner*—Frederick L. Lagman
(74) *Attorney, Agent, or Firm*—Felsman, Bradley, Vaden, Gunter & Dillon, L.L.P.; James E. Bradley

(57) ABSTRACT

A subsea well has a tubing hanger which has an annulus bore and a production bore. A check valve is located in the annulus bore. A running tool runs the tubing hanger on a monobore riser such as a drill string while holding the check valve in the open position. After setting and testing, the running tool is lifted and a blowout preventer is closed around the landing string. The operator monitors the choke and kill line of the drilling riser, which will be in communication with the check valve. If the check valve is leaking, an annulus plug may be installed in the annulus bore. The installation of the annulus plug may be handled by using a retrieval tool configured to align the annulus bore with the landing string passage. A wireline tool may be lowered through the landing string and retrieval tool to retrieve the check valve and install the plug. Alternately, the check valve may remain in the tubing hanger and the plug is set in the annulus bore above it. The check valve is retained in the open position, if so.

21 Claims, 6 Drawing Sheets

ANNULUS CHECK VALVE WITH TUBING PLUG BACK-UP

CROSS-REFERENCE TO RELATED APPLICATION

This application claims the benefit of provisional application Ser. No. 60/060,550, filed Oct. 2, 1997.

TECHNICAL FIELD

This invention relates in general to subsea wellheads, and in particular to a tubing hanger having a production passage, an annulus passage, and a retrievable check valve in the annulus passage.

BACKGROUND ART

A common method of completing a subsea well involves installing a high pressure wellhead housing at the sea floor. Multiple strings of casing will be supported at the wellhead housing and extend into the well. Then a tubing hanger with a string of tubing and other downhole equipment such as a packers, will be run into the casing and landed in the wellhead housing. The steps of drilling through the high pressure wellhead housing, running the casing and running the tubing are performed through a drilling riser and blowout preventer.

The tubing hanger running tool will normally be attached to a dual completion riser which has one conduit in communication with a production bore in the tubing hanger and another conduit in communication with an annulus bore in the tubing hanger. The production and annulus bores are parallel to and offset from each other. Tubing annulus communication is needed for certain operations during completion. After the tubing string has been landed and the tubing hanger set, the operator runs plugs on wireline through the completion riser conduits, one plug sealing the annulus bore and the other plug sealing the production bore.

The operator then removes the dual string completion riser and the drilling riser along with the blowout preventer. The operator then runs a Christmas tree, landing the tree on the wellhead housing and completing the well. The wireline plug(s) in the production bore and annulus are removed for production.

It is expensive for a drilling rig to have a dual string completion riser in addition to a drilling riser. It would be preferable to be able to run the dual bore tubing hanger through the drilling riser on a single monobore conduit such as a string of drill pipe. Running on a drill string, however, does not readily allow a wireline plug to be installed in the annulus bore in the tubing hanger, because the drill string bore is aligned with the production bore. Tubing hangers with various valves for the annulus have been proposed, but have not been used extensively because of reliability concerns. Check valves have been used in the tubing hanger annulus bore in the past, but are not in general use because of reliability concerns and because of the inability of being able to test from above prior to removing the blowout preventer.

DISCLOSURE OF INVENTION

In this invention, the tubing hanger has a check valve located in the annulus bore. The running tool runs the tubing hanger on a monobore string while holding the check valve in the open position. After setting and testing, the running tool is lifted and the blowout preventer is closed around the landing string. The operator monitors the choke and kill line of the drilling riser, which will be in communication with the check valve. If the check valve is leaking, an annulus plug may be installed in the annulus bore.

In one embodiment, the installation of the annulus plug is handled by retrieving the running tool. A retrieval tool is lowered into engagement with the tubing hanger. The retrieval tool is configured to align the annulus bore with the drill string passage. A wireline tool will be lowered through the drill string to retrieve the check valve and install the plug.

In the other embodiment, the check valve remains in the tubing hanger and the plug is set in the annulus bore above it. The check valve is retained in the open position.

MODE FOR CARRYING OUT THE INVENTION

Figure 1:
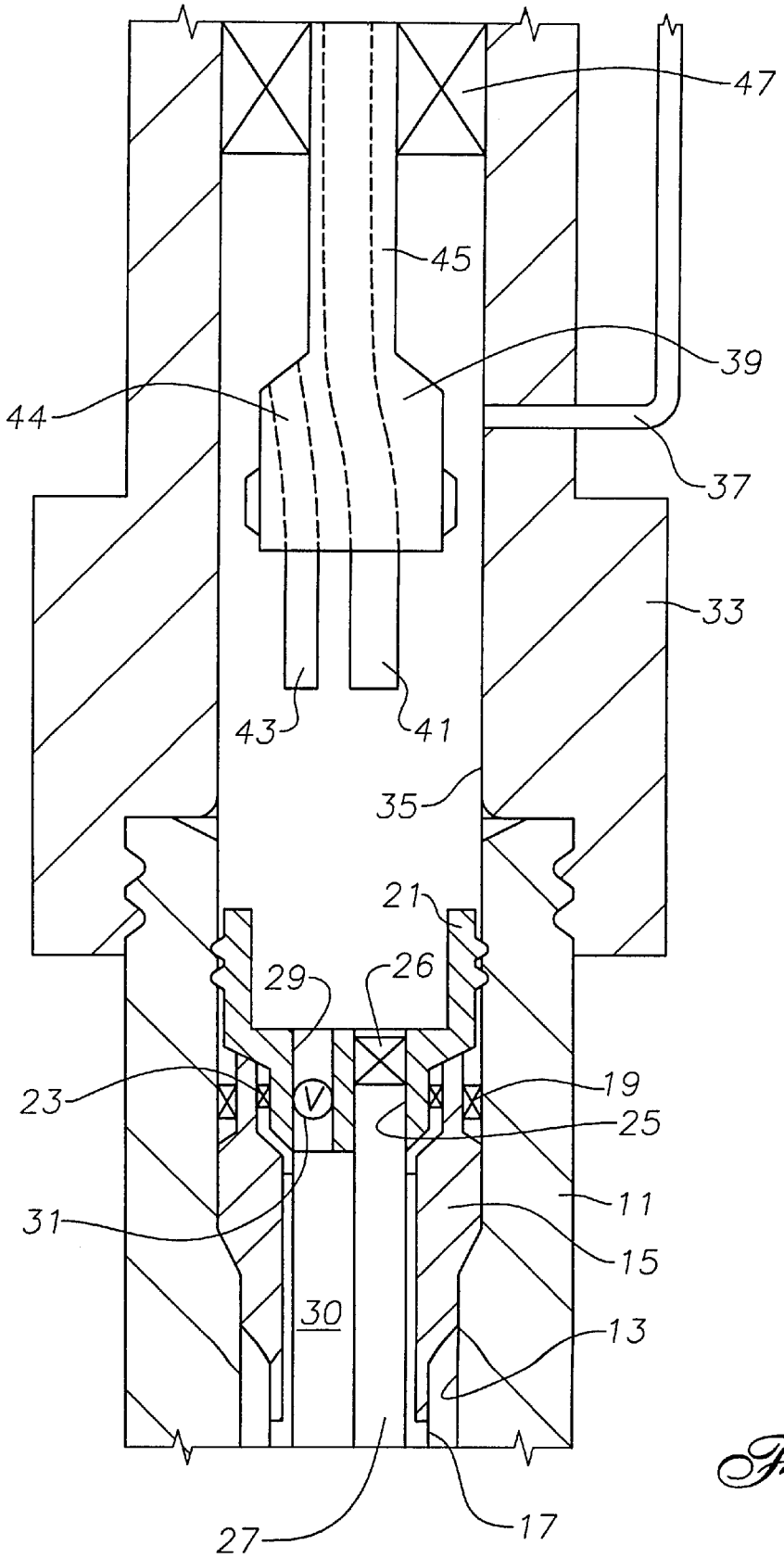
FIG. 1 is a schematic view illustrating a tubing hanger according to a first embodiment of the invention installed in a wellhead housing, with a running tool released and pulled up from the tubing hanger.

Referring to FIG. 1, a wellhead housing 11 is installed on the sea floor. Wellhead housing 11 has a bore 13. A casing hanger 15 is shown landed on a shoulder in bore 13. Casing hanger 15 is secured to the upper end of a string of casing. There will be additional casing hangers and casing strings which are not shown. Drill casing hanger seal 19 seals the casing hanger annulus between bore 13 and drill string 17.

A tubing hanger 21 is shown landed on casing string hanger 15. Tubing hanger 21 secures to the side wall of bore 13 and is supported on the upper end of casing hanger 15. A tubing hanger seal 23 seals the body of tubing hanger 21 to the bowl of casing hanger 15. Tubing hanger 21 has a production bore 25 extending through it and is secured to a string of tubing 27 extending into the casing string 17. A retrievable wireline plug 26 is shown installed in production bore 25. An annulus bore 29 is parallel to and offset from production bore 25 for providing communication from annulus 30 surrounding tubing 27. A check valve 31 is located in annulus bore 29. Check valve 31 is normally closed in a position that prevents upward flow from tubing annulus 30 but allows downward flow into tubing annulus 30.

A drilling riser 33 is secured to wellhead housing 11. Riser 33 has a bore 35 that is large enough to run casing hanger 15 and tubing hanger 21. Riser 33 has an exterior set of conduits, including a choke-and-kill line 37 that leads to the vessel at the surface from riser bore 35 at a point near its lower end.

Running tool 39 runs tubing hanger 21. Running tool 39 is shown schematically and will also include a subsea test tree (not shown) with valves for testing the well. Running tool 39 has a production bore isolation sleeve 41 that stabs or slides into production bore 25. Running tool 39 also has an annulus bore isolation sleeve 43 that stabs into annulus bore 29 above annulus valve 31. Isolation sleeve 43 communicates with a passage 44 in running tool 39 which leads to the exterior of running tool 39. A monobore riser such as landing string 45 lowers running tool 39 and retrieves it. A blowout preventer 47 in riser 33 may be closed around landing string 45, forming a closed chamber which communicates with choke-and-kill line 37.

Running tool 39 along with the subsea test tree will be secured to tubing hanger 21 at the surface, with the isolation sleeves 43, 41 located within bores 29, 25 respectively. Tubing hanger running tool 39 has a device which, when coupled to tubing hanger 21, opens check valve 31. Tubing hanger 21 will be run with running tool 39 and drill string 45 through riser 33. During running, wireline plug 26 will not be present. Check valve 31 is open during running and will remain open as long as running tool 39 is connected to tubing hanger 21. While running tool 39 is connected to tubing hanger 21, the operator can circulate back up annulus 30 by pumping down landing string 45, through production bore 25 and tubing 27. The return circulation from tubing annulus 30 flows upward past check valve 31 because it is held open by running tool 39. The return circulation flows through annulus isolation sleeve 43, passage 44, and into the annulus surrounding landing string 45. The circulation can either flow up the riser annulus in bore 35 or up the choke-and-kill line 37.

After the tubing hanger 21 has been set and tested, the operator will install wireline plug 26 in production bore 25 by lowering plug 26 through landing string 45. The operator will close the pipe rams of the blowout preventer 47 and monitor through the choke-and-kill line 37 for pressure build-up in the tubing annulus 30. The operator will then pull up the running tool 39 a short distance, which typically is below the blowout preventer 47. Check valve 31 will automatically close, preventing any upward flow from tubing annulus 30. The operator can close blowout preventer 47 around landing string 45 and test tubing annulus 30 for leakage through the choke-and-kill line 37. If running tool 39 is pulled above blowout preventer 47, the operator can close the blind rams of blowout preventer 47 and monitor through the choke-and-kill line 37.

Normally, there would not be any pressure in tubing annulus 30, and if so, check valve 31 should contain the pressure. Any pressure build-up monitored in the choke and kill line 37 would indicate a malfunction of check valve 31. Assuming that check valve 31 is operating properly, the operator retrieves running tool 39 and retrieves riser 33. The operator then installs a christmas tree in a normal manner. Check valve 31 will remain in place, however and may be checked open by the annulus isolation sleeve 43. If desired, circulation down annulus 30 may be made through check valve 31, to kill the annulus with return flow up tubing 27.

In the unlikely event that a pressure build-up is detected while running tool 39 is suspended below the closed blowout preventer 47 as shown in FIG. 1, check valve 31 can be retrieved and a conventional wireline plug (not shown) installed before retrieving riser 33. This could be handled in various manners. One manner would be to retrieve running tool 39 and install a kick-off sub or other type of adapter to running tool 39 that would register the passage of landing string 45 with annulus bore 29. The operator would then rerun running tool 39 back into engagement with tubing hanger 21. The operator then lowers a wireline retrieval tool through the drill string which will remove check valve 31. A profile is present within annulus bore 29 for installing a wireline plug. After removing check valve 31, the operator runs a conventional wireline plug.

Figure 2A:
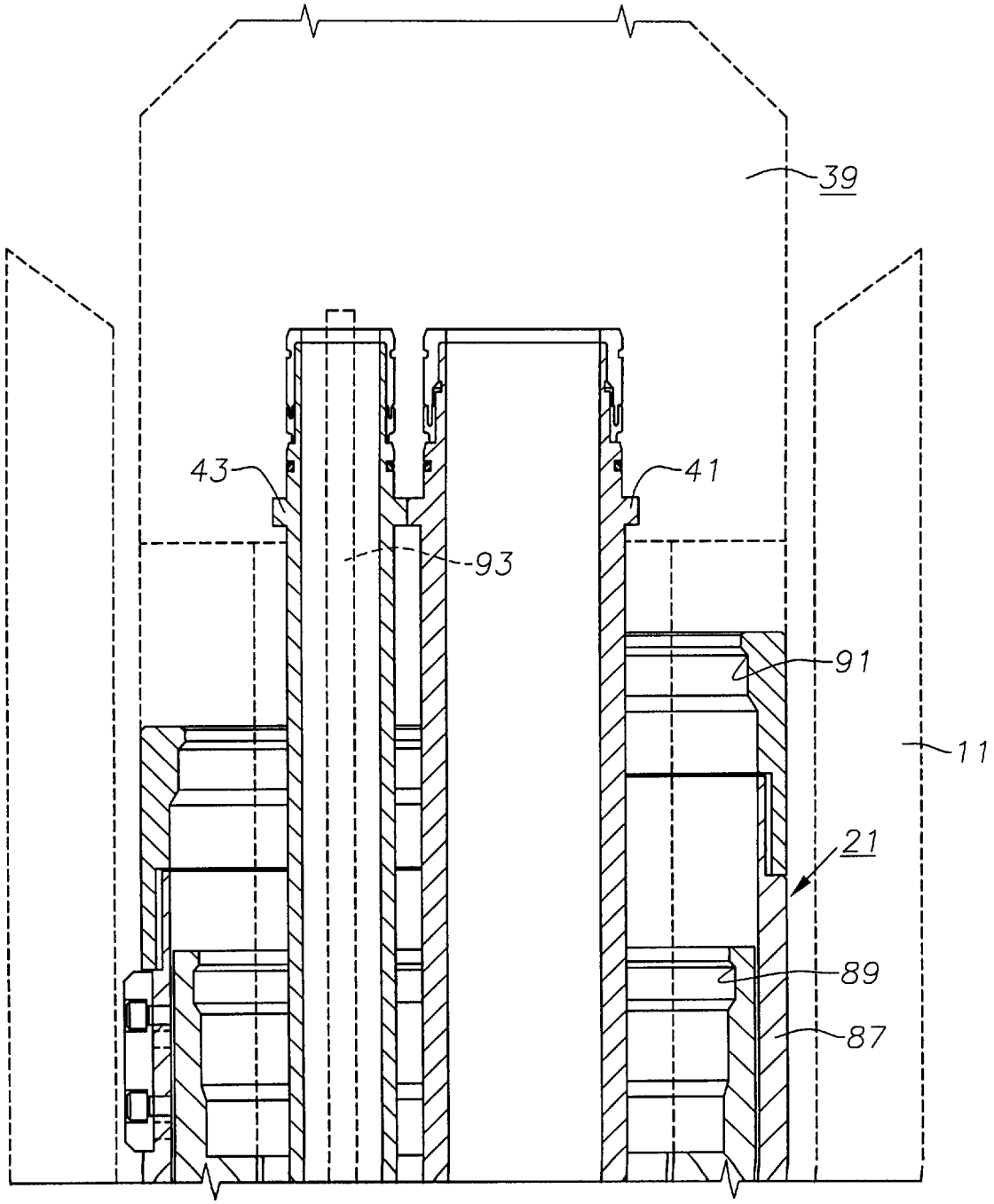
FIGS. 2A and 2B comprise a vertical sectional view illustrating the tubing hanger of FIG. 1, with a first embodiment of an annulus check valve assembly constructed in accordance with this invention.
Figure 2B:
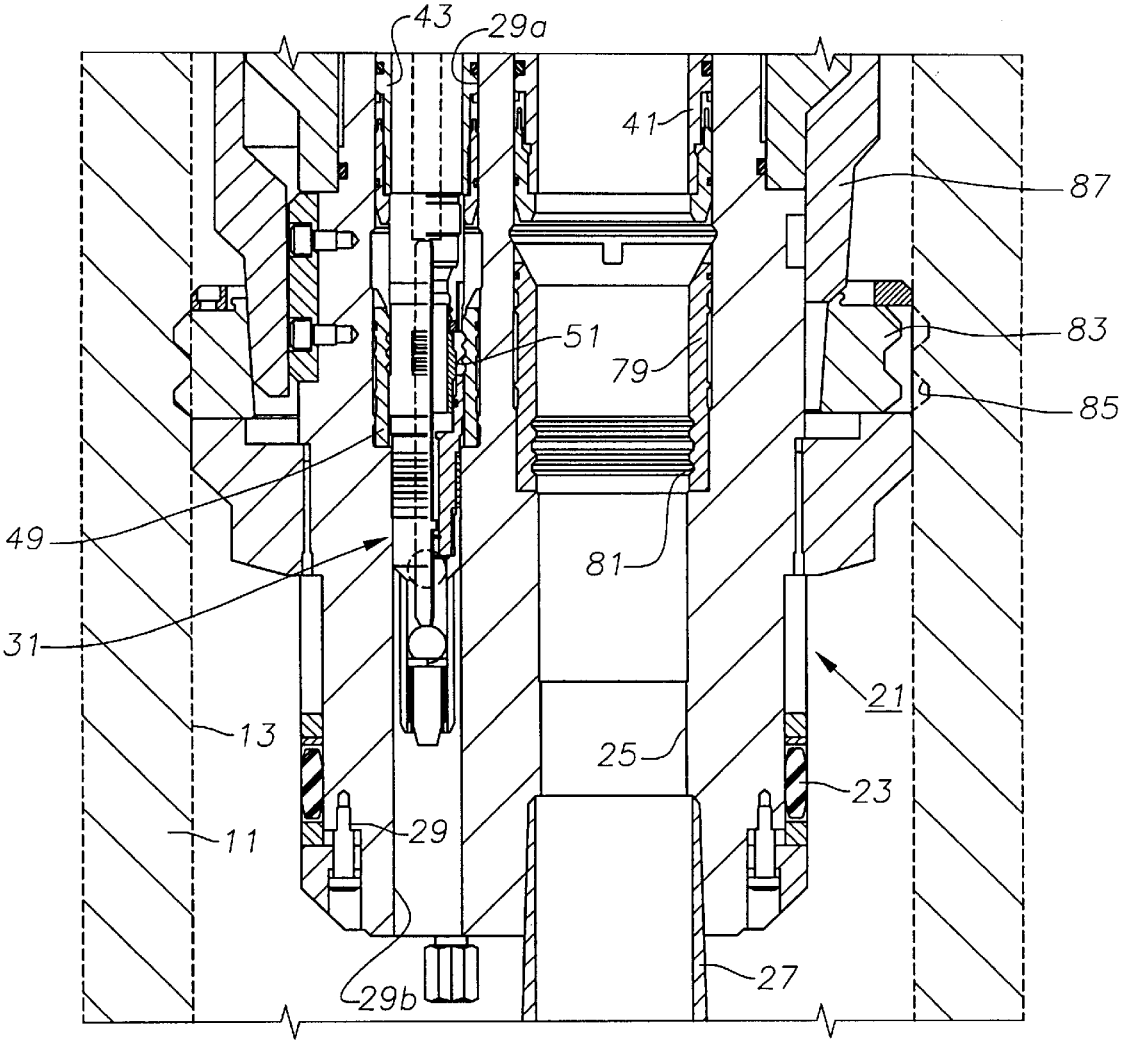
Figure 3:
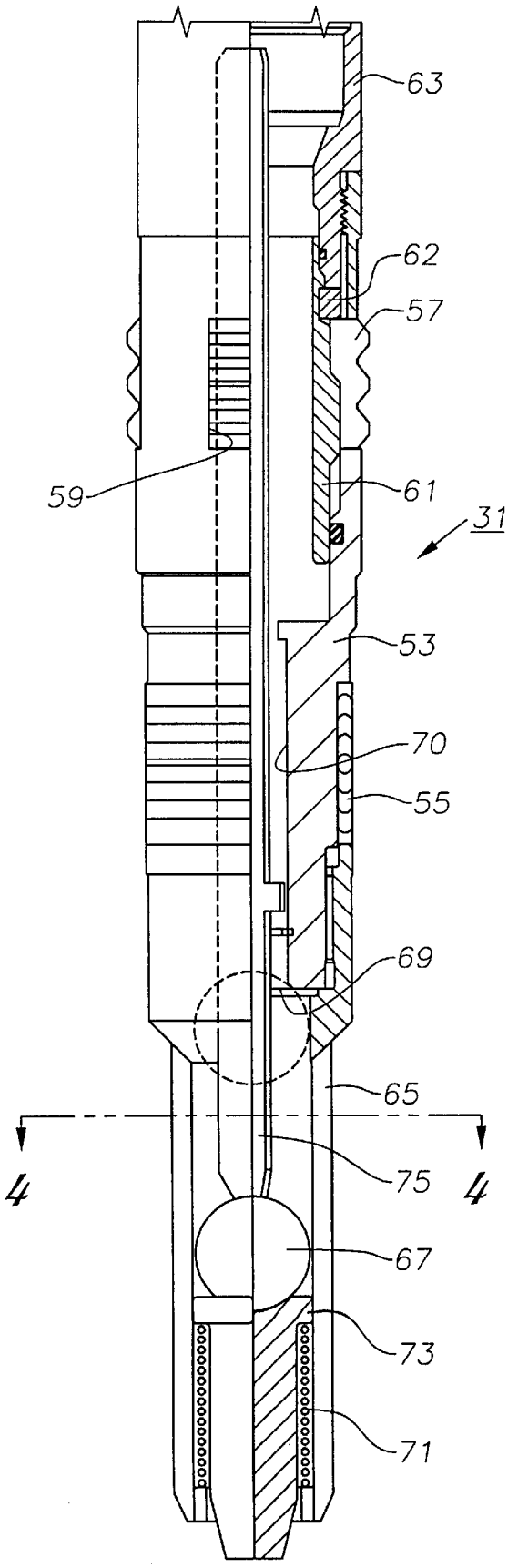
FIG. 3 is a vertical sectional view of the check valve assembly shown in FIG. 2B.
Figure 4:
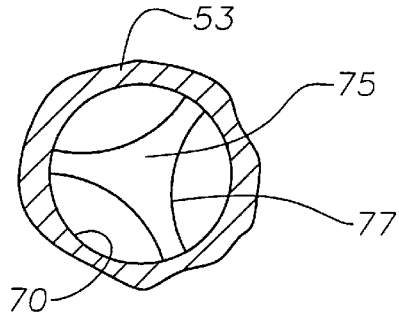
FIG. 4 is a transverse sectional view of the check valve assembly of FIG. 3 taken along the line 4—4 of FIG. 3.

FIGS. 2–4 show more details of the assembly. Referring to FIG. 2B, tubing hanger annulus bore 29 has an upper section 29*a* and a lower section 29*b* of lesser diameter. A threaded sleeve 49 is installed in upper section 29*a*. Threaded sleeve 49 has a grooved profile 51 in its bore. The diameter of the bore of threaded sleeve 49 is the same as the bore of annulus bore isolation sleeve 43. Check valve 31 seals in annulus bore lower section 29*b* and locks into grooves 51 in threaded sleeve 49. In the event of a failure of check valve 31, after it is pulled, a wireline plug may be lowered into annulus lower section 29*b* and locked into grooved profile 51.

Referring to FIG. 3, check valve 31 has a tubular body 53 with a seal 55 on its exterior. Seal 55 sealingly engages annulus bore lower section 29*b* (FIG. 2B). A plurality of dogs 57 locate in windows 59 of body 53. The dogs 57 have grooved exteriors for engaging grooved profile 51 in threaded sleeve 49 (FIG. 2*b*). Dogs 57 are movable from an engaged position shown to a retracted position. A cam ring 61 locates inside dogs 57 for moving dogs 57 between the retracted and engaged positions. Cam ring 61 has an upper end which engages a split detent ring 62, which in turn bears against an upper edge of each dog 57. Split ring 62 releasably retains cam ring 61 in an upper position. A retrieval tool (not shown) has a mechanism which will engage cam ring 61 and push it downward relative to dogs 57 to allow them to retract. Detent ring 62 flexes outward, releasing cam ring 61, to allow this downward movement. The retrieval tool engages a profile in a fishing head 63 so that the tool can axially move cam ring 61 from its upper to its lower position.

A cage 65 extends downward from the lower end of body 53. Cage 65 comprises spaced apart longitudinal ribs defining elongated apertures between them to allow fluid flow. A ball 67 carried within cage 65 moves between the lower open position shown by solid lines and the upper closed position shown by dotted lines. In the upper closed position, ball 67 engages a seat 69 on the lower end of an axial passage 70 which extends through body 53. A spring 71 having a spring retainer 73 on its upper end engages ball 67 and urges ball 67 to the closed position in contact with seat 69.

Check valve assembly 31 has an axial rod 75 to selectively hold ball 67 in the open position shown. Rod 75 has a lower end which contacts ball 67 and an upper end in fishing head 63. Rod 75 is shaped in a general Y-shape as shown in FIG. 4 to allow fluid flow through passage 70. Rod 75 has three legs spaced 120° apart which contact the side wall of passage 70. Rod 75 will move between the upper and lower positions with ball 67.

Referring to FIG. 2B, a threaded sleeve 79 is located in an enlarged area of production bore 25. Threaded sleeve 79 has a grooved profile 81 for receiving wireline plug 26 (FIG. 1). A locking member 83 locks tubing hanger 21 to a profile 85 in wellhead housing 11. Locking member 83 has a mating grooved profile on its exterior. A cam sleeve 87, when moved downward, will push locking member 83 outward to the engaged position.

Referring to FIG. 2A, a body profile 89 is formed on the upper end of the body of tubing hanger 21. Cam sleeve 87 has a running tool profile 91 on its upper end. Running tool 39 has a member which engages cam sleeve profile 91 and another member which engages body profile 89 to run and set tubing hanger 21. Running tool 39 has a stinger 93 which extends downward through annulus isolation sleeve 43 into contact with the upper end of rod 75. Running tool stinger 93 keeps rod 75 in the lower position, holding check valve 31 in the open position.

As previously explained, check valve 31 allows free flow both in the upward and downward directions through annulus bore 29 while it is in the open position. When running tool 39 is lifted upward from tubing hanger 21, stinger 93 and rod 75 move upward also, allowing spring 71 to close ball 67 against seat 69. If a malfunction occurs, necessitating the running of a wireline plug, running tool 39 will be retrieved and reconfigured so that a wireline passage will be present from annulus bore 29 to landing string 45. Check valve 31 may be retrieved by engaging fishing head 63 with a wireline tool, then causing cam ring 61 to move to a lower position to allow dogs 57 to retract. Check valve 31 will be retrieved and replaced with a conventional wireline plug which will seal in lower annulus bore section 29*b* and lock in groove profile 51 of threaded sleeve 49 (FIG. 2*b*).

Figure 5:
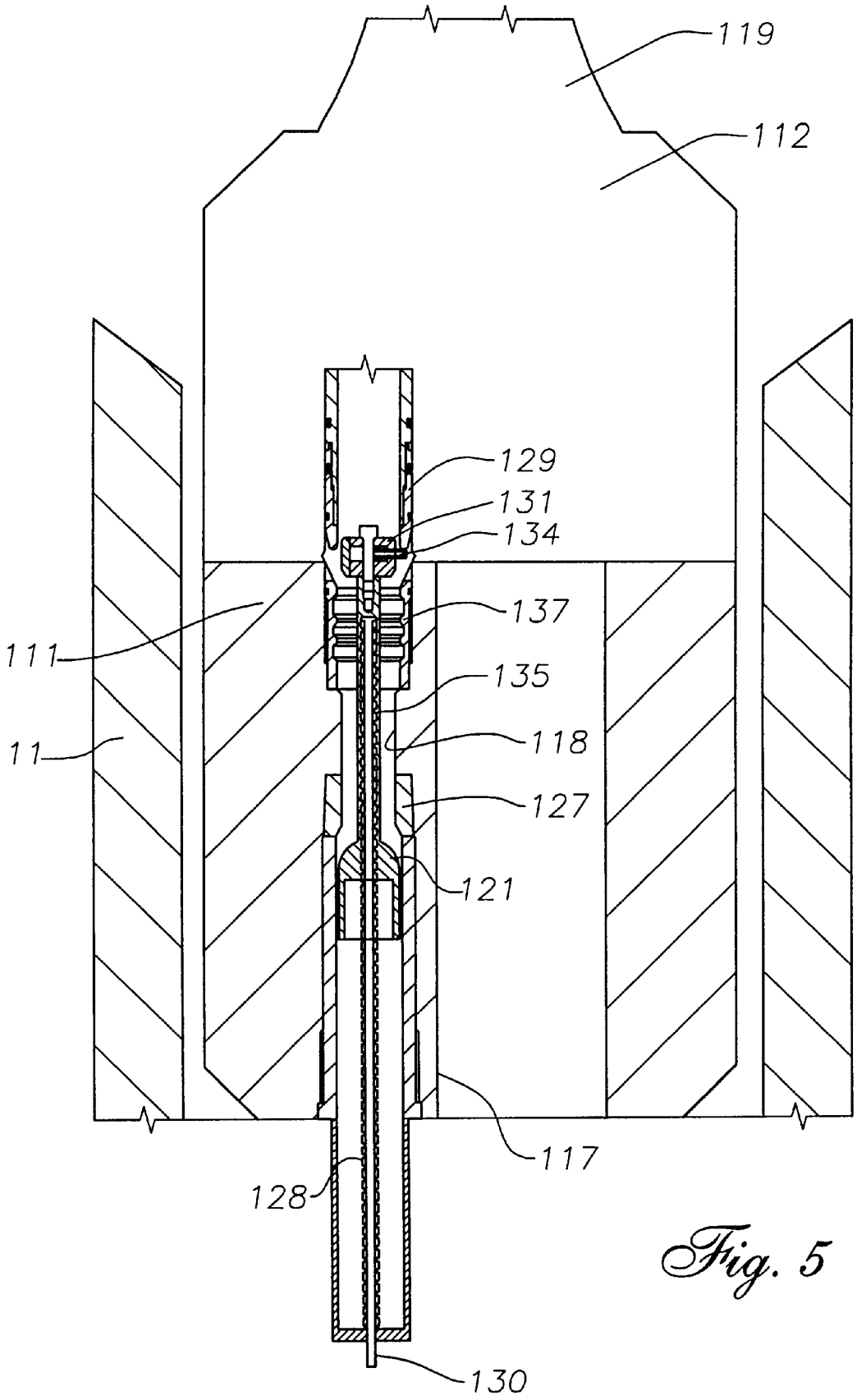
FIG. 5 is a vertical sectional view of the check valve of the second embodiment, shown with the running tool attached.
Figure 6:
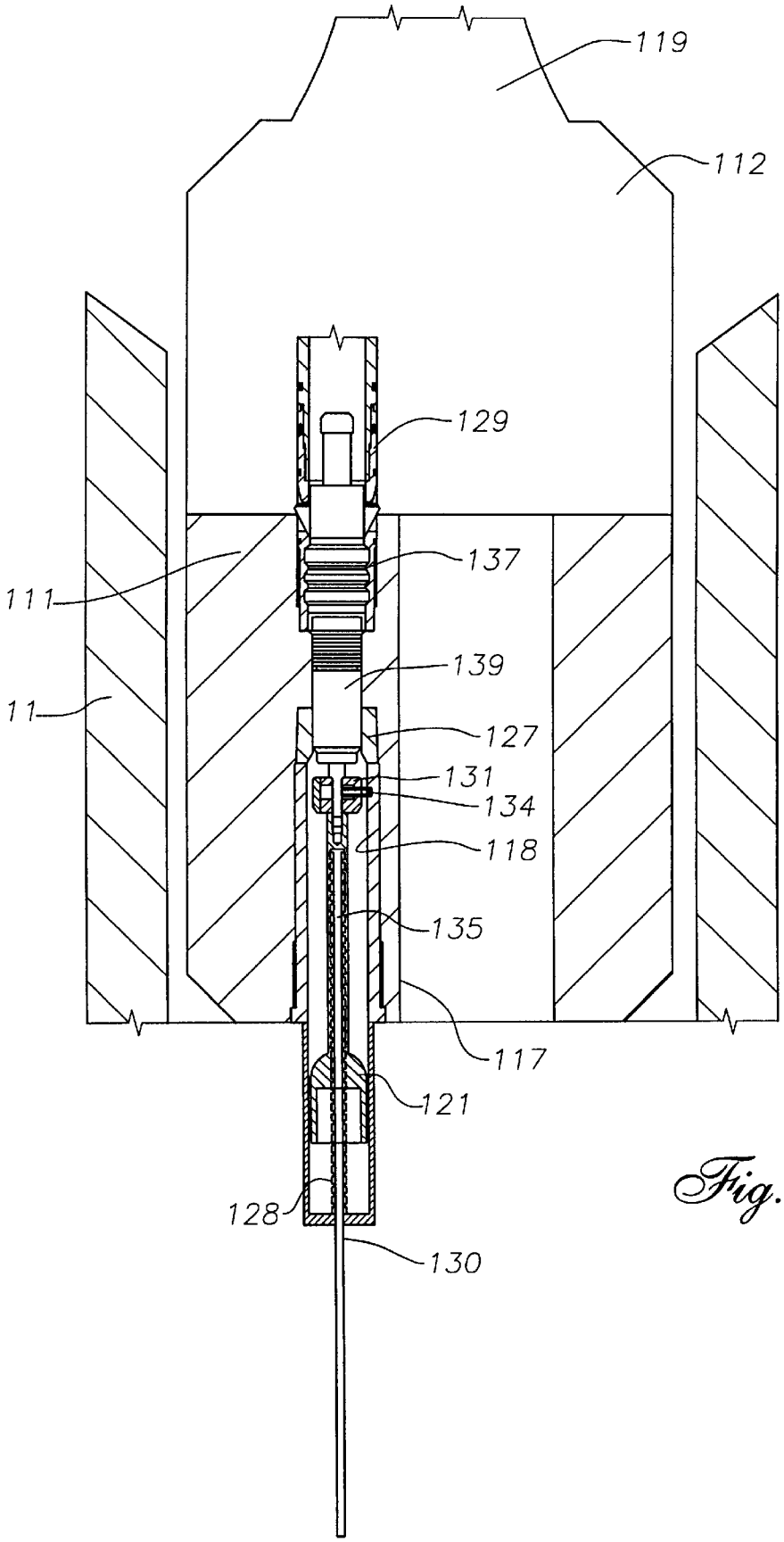
FIG. 6 is a vertical sectional view of the check valve of FIG. 5 pushed downward and replaced by a plug.

FIGS. 5 and 6 show an alternate embodiment of the invention. Tubing hanger 111 will land in a wellhead housing 11. A riser 33 (FIG. 1) extends from wellhead housing 11 to the surface. A running tool 112 is connected to landing string 45 (FIG. 1) to run tubing hanger 111 along with a string of tubing. Tubing hanger 111 has one vertical bore 117 for the passage of production fluids, vertical bore 117 being in communication with the production tubing and with landing string 45 via a stinger (not shown) on running tool 112. Tubing hanger 111 also has an offset bore 118 for communicating with the tubing annulus. A check valve 121 is located in annulus bore 118. Check valve 121 allows downward flow, but not upward flow. While running in, check valve 121 is held open by a stinger 129 on running tool 112. This allows fluid flow to and from the tubing annulus during the running and setting procedure.

Check valve 121 has a movable element which seals against a seat 127 in a closed position and is biased to the closed position by a spring 128 which surrounds a slidable rod 130. Stinger 129 on the running tool 112 pushes against a retainer 131 at the upper end of a rod or neck 135 which is connected to check valve 121. Retainer 131 has three protruding spring biased fingers 134 against which the rim of stinger 129 pushes. A plug profile 137 is located in bore 118 above check valve 121. In the operational position, retainer 131 remains above seat 127, however, it can be pushed downward below seat 127. When pushed below, it will not move upward past seat 127 because of fingers 134. This retains check valve 121 in an open position shown in FIG. 6.

During running-in, check valve 121 will be held open by stinger 129 of running tool 112, as shown in FIG. 5. As shown in FIG. 6, after landing and sealing tubing hanger 111, a plug will be lowered through landing string 119 and into production bore 117. The operator then picks up running tool 112 and closes the BOP (not shown) around landing string 119. The operator monitors the pressure above tubing hanger 111 through a choke-and-kill line (not shown) similar to choke-and-kill line 37 of FIG. 1. If there is no pressure buildup, this indicates that check valve 121 is holding or that there is no tubing annulus pressure. With the tubing hanger 111 safely plugged, the operator could then remove the BOP and riser and install a Christmas tree (not shown). The tree has a stinger which will open check valve 121.

If there is leakage of check valve 121, it would not be safe to remove the BOP and riser. The operator will therefore retrieve landing string 119 and running tool 112, install a plug 139 in running tool 112 and return to tubing hanger 111 as shown in FIG. 6. When landing on tubing hanger 111, plug 139 is pushed by stinger 129 downward into latching engagement with profile 137. Plug 139 will engage retainer 131 and push check valve 121 down to an inoperative latched position. Spring biased fingers 134 allow the check valve 121 to move past the constricted bore above seat 127. Retainer 131 holds check valve 137 in the open but latched position. After the tree is installed, plug 139 could be removed.

The invention has significant advantages. The check valve system allows an operator to run and test tubing with a monobore riser such as drill string. Leakage may be checked through the choke and kill line. The check valve may be replaced by a plug in the event of leakage.

While the invention has been shown in only two of its embodiments, it should be apparent to those skilled in the art that it is not so limited but may be modified without departing from the scope of the invention.

We claim:

1. A method for installing a tubing hanger in a subsea wellhead, the tubing hanger having a production bore and an offset tubing annulus bore extending therethrough, the wellhead being in communication with a vessel at the surface via a riser which contains a blowout preventer, the method comprising:

(a) installing a valve in the annulus bore;

(b) securing the tubing hanger to a running tool;

(c) opening the valve with the running tool, securing the running tool to a monobore conduit, lowering the tubing hanger through the riser with the conduit, and setting the tubing hanger in the wellhead; then (d) installing a retrievable production plug in the production bore;

(e) releasing the running tool from the tubing hanger and closing the valve; then (f) determining if the valve leaks; and if so, (g) installing an annulus plug in the annulus bore; and wherein step (f) comprises:

lifting the running tool from the tubing hanger; then closing the blowout preventer around the conduit, creating a chamber within the riser in communication with the annulus bore; then monitoring pressure in the chamber through a choke and kill line incorporated with the riser.

2. The method according to claim 1, wherein step (g) comprises:

moving and retaining the valve in an open position and installing the annulus plug in the annulus bore above the valve while the valve remains in the open position.

3. A method for installing a tubing hanger in a subsea wellhead, the tubing hanger having a production bore and an offset tubing annulus bore extending therethrough, the wellhead being in communication with a vessel at the surface via a riser which contains a blowout preventer, the method comprising:

(a) installing a valve in the annulus bore;

(b) securing the tubing hanger to a running tool;

(c) opening the valve with the running tool, securing the running tool to a monobore conduit, lowering the tubing hanger through the riser with the conduit, and setting the tubing hanger in the wellhead; then (d) installing a retrievable production plug in the production bore;

(e) releasing the running tool from the tubing hanger and closing the valve; then (f) determining if the valve leaks; and if so, (g) installing an annulus plug in the annulus bore; wherein step (c) includes:

closing the blowout preventer around the conduit while the running tool is engaged with the tubing hanger, creating a chamber within the riser which communicates with the vessel through a choke and kill line incorporated with the riser; and providing an annulus passageway in the running tool for communicating the tubing annulus bore with the chamber, and thereby with the vessel through the choke and kill line.

4. A method for installing a tubing hanger in a subsea wellhead, the tubing hanger having a production bore and an offset tubing annulus bore extending therethrough, the wellhead being in communication with a vessel at the surface via a riser which contains a blowout preventer, the method comprising:

(a) installing a check valve in the annulus bore;

(b) securing the tubing hanger to a running tool;

(c) opening the check valve with the running tool, securing the running tool to a monobore conduit, lowering the tubing hanger through the riser with the conduit, and setting the tubing hanger in the wellhead; then (d) installing a retrievable production plug in the production bore;

(e) releasing the running tool from the tubing hanger and closing the check valve; then (f) determining if the check valve leaks; and if so, (g) installing an annulus plug in the annulus bore; and wherein step (g) comprises retrieving the check valve, then installing the annulus plug.

5. The method according to claim 4, wherein step (g) comprises installing the annulus plug in the annulus bore above the check valve.

6. The method according to claim 4, wherein step (g) comprises:

retrieving the running tool;

running a retrieval tool on the conduit into engagement with the tubing hanger, the retrieval tool having a passage which aligns the monobore in the conduit with the annulus bore in the tubing hanger; then retrieving the check valve through the monobore in the conduit and installing the annulus plug through the monobore in the conduit.

7. The method according to claim 4, wherein step (g) comprises:

aligning the monobore in the conduit with the annulus bore in the tubing hanger; then retrieving the check valve through the monobore in the conduit and installing the annulus plug through the monobore in the conduit.

8. A method for installing a tubing hanger in a subsea wellhead, the tubing hanger having a production bore and an offset tubing annulus bore extending therethrough, the wellhead being in communication with a vessel at the surface via a riser which contains a blowout preventer, the method comprising:

(a) installing a check valve in the annulus bore;

(b) securing the tubing hanger to a running tool;

(c) opening the check valve with the running tool, securing the running tool to a monobore conduit, lowering the tubing hanger through the riser with the conduit, and setting the tubing hanger in the wellhead; then (d) installing a retrievable production plug in the production bore;

(e) releasing the running tool from the tubing hanger and closing the check valve; then (f) determining if the check valve leaks, and if so, (g) installing an annulus plug in the annulus bore; and wherein step (c) comprises while connecting the running tool to the tubing hanger, moving a seat of the check valve downward with a stinger incorporated with the running tool.

9. A tubing hanger assembly for landing in a wellhead of a subsea well, comprising:

a production bore extending through the tubing hanger assembly;

an annulus bore extending through the tubing hanger assembly offset from the production bore;

a check valve located in the annulus bore for preventing upward flow through the annulus bore while the check valve is in a closed position;

a profile in the annulus bore for receiving an annulus plug in the event the check valve fails; and wherein the check valve secures within the profile in the annulus bore and is adapted to be retrieved and replaced by the annulus plug in the event the check valve fails.

10. The tubing hanger assembly according to claim 9, wherein the check valve is located below the profile.

11. A tubing hanger assembly for landing in a wellhead of a subsea well, comprising:

a production bore extending through the tubing hanger assembly;

an annulus bore extending through the tubing hanger assembly offset from the production bore;

a check valve located in the annulus bore for preventing upward flow through the annulus bore while the check valve is in a closed position;

a profile in the annulus bore for receiving an annulus plug in the event the check valve fails; wherein the check valve has a seat, a movable element which engages the seat, and a spring which urges the movable element upward into engagement with the seat; and wherein the movable element is adapted to be selectively pushed out of engagement with the seat by a running tool while the tubing hanger is being lowered into the wellhead.

12. A tubing hanger assembly for landing in a wellhead of a subsea well, comprising:

a production bore extending through the tubing hanger assembly;

an annulus bore extending through the tubing hanger assembly offset from the production bore;

a check valve located in the annulus bore for preventing upward flow through the annulus bore while the check valve is in a closed position;

a profile in the annulus bore for receiving an annulus plug in the event the check valve fails; wherein the check valve has a seat, a movable element which engages the seat, and a spring which urges the movable element upward into engagement with the seat; and wherein the movable element is adapted to be selectively pushed out of engagement with the seat by the annulus plug when being installed in the profile.

13. A tubing hanger assembly for landing in a wellhead of a subsea well, comprising:

a production bore extending through the tubing hanger assembly;

an annulus bore extending through the tubing hanger assembly offset from the production bore;

a check valve located in the annulus bore for preventing upward flow through the annulus bore while the check valve is in a closed position;

a profile in the annulus bore for receiving an annulus plug in the event the check valve fails; wherein the check valve has a seat located below the profile, a movable element which engages the seat, and a spring which urges the movable element upward into engagement with the seat; and wherein the tubing hanger assembly further comprises:

a rod which protrudes upward from the movable element past the seat;

a retainer mounted to the rod above the movable element, the retainer and the rod being movable from an operational position with the retainer located above the seat to a latched position wherein the retainer is located below and pressed against the seat by the spring, preventing the movable element from sealing against the seat.

14. A tubing hanger assembly for landing in a wellhead of a subsea well, comprising:

a production bore extending through the tubing hanger assembly;

an annulus bore extending through the tubing hanger assembly offset from the production bore;

a check valve located in the annulus bore for preventing upward flow through the annulus bore while the check valve is in a closed position;

a profile in the annulus bore for receiving an annulus plug in the event the check valve fails; wherein the check valve has a seat located below the profile, a movable element which engages the seat, and a spring which urges the movable element upward into engagement with the seat; and wherein the tubing hanger assembly further comprises:

a rod which protrudes upward from the movable element past the seat for engagement by a running tool stinger to selectively hold the check valve in an open position.

15. In a subsea well having a wellhead, a riser secured to the wellhead and extending upward to a vessel, a blowout preventer mounted in the riser and having a choke and kill line, an assembly for installing a tubing hanger in the wellhead, comprising:

a tubing hanger adapted to be secured to a string of tubing and having a production bore and an annulus bore offset from the production bore;

a check valve located in the annulus bore for preventing upward flow through the annulus bore while the check valve is in a closed position;

a string of conduit having a passage therethrough, the conduit adapted to be lowered from the vessel through the riser;

a running tool connected to the string of conduit and to the tubing hanger;

the running tool having a production sleeve which engages the production bore and communicates the production bore with the passage in the string of conduit;

the running tool having an annulus sleeve which engages the annulus bore and a stinger which moves the check valve to an open position; wherein lifting the running tool from the tubing hanger after installation of the tubing hanger and closing the blowout preventer around the conduit enables the check valve to be monitored in the closed position through the choke and kill line; and wherein the annulus bore has a profile for receiving an annulus plug in the event the check valve fails.

16. The tubing hanger assembly according to claim 15, wherein the check valve secures within the profile in the annulus bore and is adapted to be retrieved and replaced by the annulus plug in the event the check valve fails.

17. The tubing hanger assembly according to claim 15, wherein the check valve is located below the profile.

18. The tubing hanger assembly according to claim 15, wherein the check valve has a seat, a movable element which engages the seat, and a spring which urges the movable element upward into engagement with the seat; and wherein the movable element is adapted to be selectively pushed out of engagement with the seat by the stinger of the running tool while the tubing hanger is being lowered into the wellhead.

19. The tubing hanger assembly according to claim 15, wherein the check valve has a seat, a movable element which engages the seat, and a spring which urges the movable element upward into engagement with the seat; and wherein the movable element is adapted to be selectively pushed out of engagement with the seat by the annulus plug when being installed in the profile.

20. The tubing hanger assembly according to claim 15, wherein the check valve has a seat located below the profile, a movable element which engages the seat, and a spring which urges the movable element upward into engagement with the seat; and wherein the tubing hanger assembly further comprises:

a rod which protrudes upward from the movable element past the seat;

a retainer mounted to the rod above the movable element, the retainer and the rod being movable from an operational position with the retainer located above the seat for engagement by the stinger of the running tool to a latched position wherein the retainer is located below and pressed against the seat by the spring, preventing the movable element from sealing against the seat, the retainer being adapted to be moved to the latched position by the annulus plug when installed.

21. The tubing hanger assembly according to claim 15, wherein the check valve has a seat located below the profile, a movable element which engages the seat, and a spring which urges the movable element upward into engagement with the seat; and wherein the tubing hanger assembly further comprises:

a rod which protrudes upward from the movable element past the seat for engagement by the stinger of the running tool to hold the check valve in an open position.

* * * * *